US007255240B2

(12) United States Patent
Mullaly et al.

(10) Patent No.: US 7,255,240 B2
(45) Date of Patent: Aug. 14, 2007

(54) LOCKING MAGAZINE HOLDER

(76) Inventors: Scott Mullaly, 517 Cassou Rd., San Marcos, CA (US) 92069; Douglas Wyatt Mullaly, 517 Cassou Rd., San Marcos, CA (US) 92069

( * ) Notice: Subject to any disclaimer, the term of this patent is extended or adjusted under 35 U.S.C. 154(b) by 553 days.

(21) Appl. No.: 10/696,677

(22) Filed: Oct. 29, 2003

(65) Prior Publication Data

US 2005/0092747 A1 May 5, 2005

(51) Int. Cl.
*B65D 21/00* (2006.01)

(52) U.S. Cl. ..... 220/23.83

(58) Field of Classification Search ..... None
See application file for complete search history.

(56) References Cited

U.S. PATENT DOCUMENTS 5,456,357 A * 10/1995 Wenner et al. ..... 206/372
6,178,897 B1 * 1/2001 Appeltans et al. ..... 109/33

* cited by examiner

*Primary Examiner*—Stephen J. Castellano
(74) *Attorney, Agent, or Firm*—Walter J. Tencza

(57) ABSTRACT

An apparatus is disclosed comprising a base and a container. The container typically includes a top portion and a bottom portion, wherein the top portion is hinged to the bottom portion. The container is fixed to the base so that the top portion can be rotated upwards to reveal a cavity in the container for storing objects. The container may include a lock which can be locked to prevent the cavity from being exposed. The base may have an open box structure with a chamber in which the container is placed.

11 Claims, 4 Drawing Sheets

LOCKING MAGAZINE HOLDER

FIELD OF THE INVENTION

This invention relates to improved methods and apparatus concerning object holders, such as magazine racks.

BACKGROUND OF THE INVENTION

Typically in the prior art magazine racks or book shelves are provided so that anyone can access any of the magazines or books located thereon. However, some reading material, for example, may be undesirable for children, and there is a need to prevent access to such material. There is also a need to keep collectables safe from others.

SUMMARY OF THE INVENTION

The present invention, in one or more embodiments, provides an apparatus comprising a base and a container. The container typically includes a top portion and a bottom portion, wherein the top portion is hinged to the bottom portion. The container may be fixed to the base so that the top portion can be rotated upwards to reveal a cavity in the container for storing objects. The container may include a lock which can be locked to prevent the cavity from being exposed. The base may have an open box structure with a chamber in which the container is placed. The base may be a magazine rack.

A method is further provided comprised of inserting a container through an opening in a base having an open box structure, and thereafter fixing the container to the base inside a chamber of the base. The method may further include placing a magazine in the cavity of the container and locking the container so that the magazine cannot be accessed.

DETAILED DESCRIPTION OF THE DRAWINGS

Figure 1:
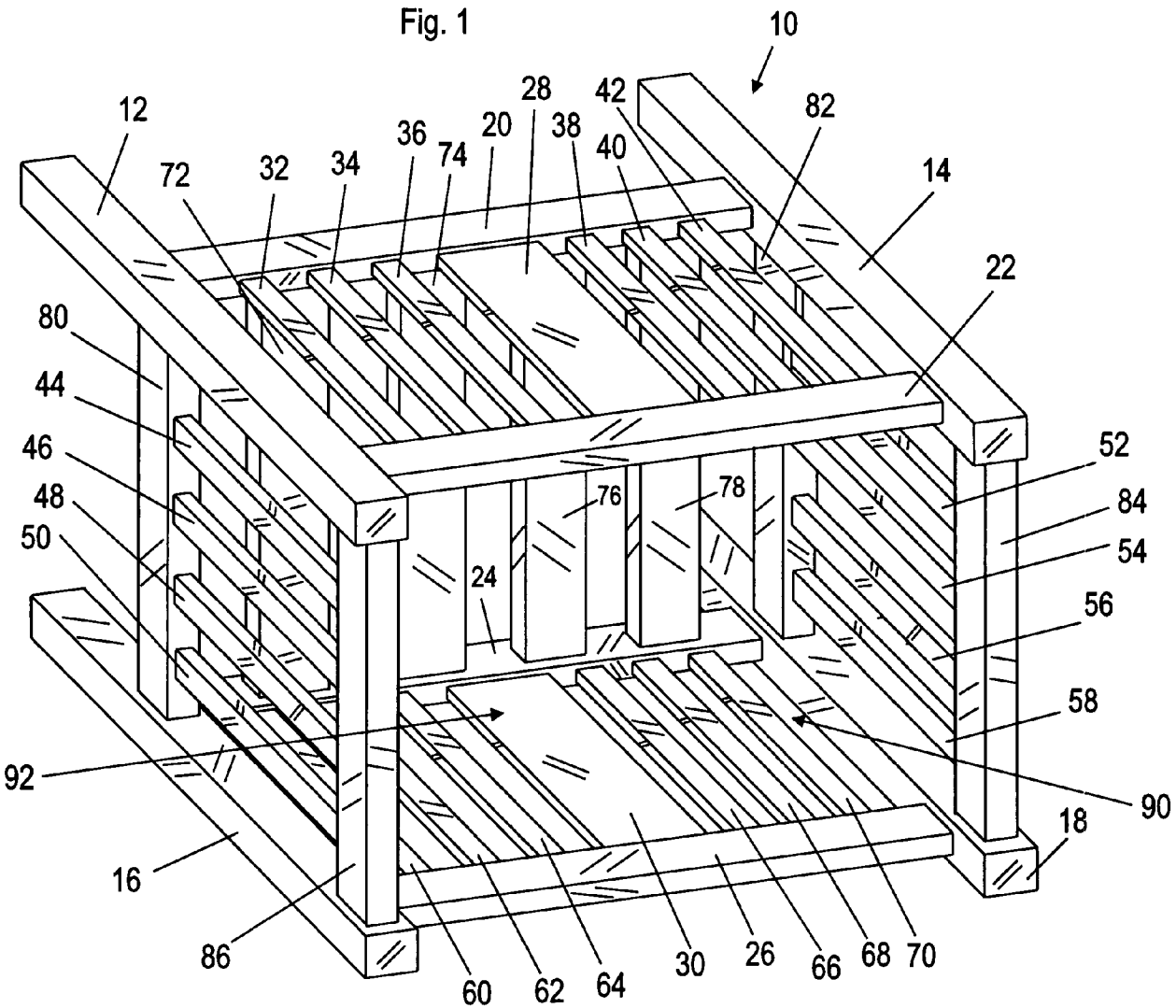
FIG. 1 shows a perspective view of a base for use with an apparatus in accordance with an embodiment of the present invention.

FIG. 1 shows a perspective view of a base 10 for use with an apparatus 1 (shown in FIG. 4) in accordance with an embodiment of the present invention. The base 10 may be comprised of members 12, 14, 16, and 18, members 20, 22, 24, and 26, members 28 and 30, members 32, 34, 36, 38, 40, and 42, members 44, 46, 48, and 50, members 52, 54, 56, and 58, members 60, 62, 64, 66, 68, and 70, and column members 80, 82, 84, and 86. Members 44, 46, 48, and 50 have first and second ends which are connected to the column members 80 and 86, respectively. Members 52, 54, 56, and 58 have first and second ends which are connected to the column members 82 and 84, respectively. Members 60, 62, 64, 30, 66, 68, and 70 have first and second ends which are connected to members 24 and 26, respectively.

Members 32, 34, 36, 28, 38, 40, and 42 have first and second ends which are connected to members 20 and 22 respectively. Members 72, 74, 76, and 78 have first and second ends which are connected to members 20 and 24, respectively. Column members 80 and 86 have first and second ends which are connected to members 12 and 16 respectively. Column members 82 and 84 have first and second ends which are connected to members 14 and 18, respectively.

Magazines or books can be inserted into the base 10 through the opening 90. The base 10 may be used as a magazine or book holder or rack. The box 10 has a substantially open box structure which the opening 90 leading to a cavity or chamber 92.

Figure 2:
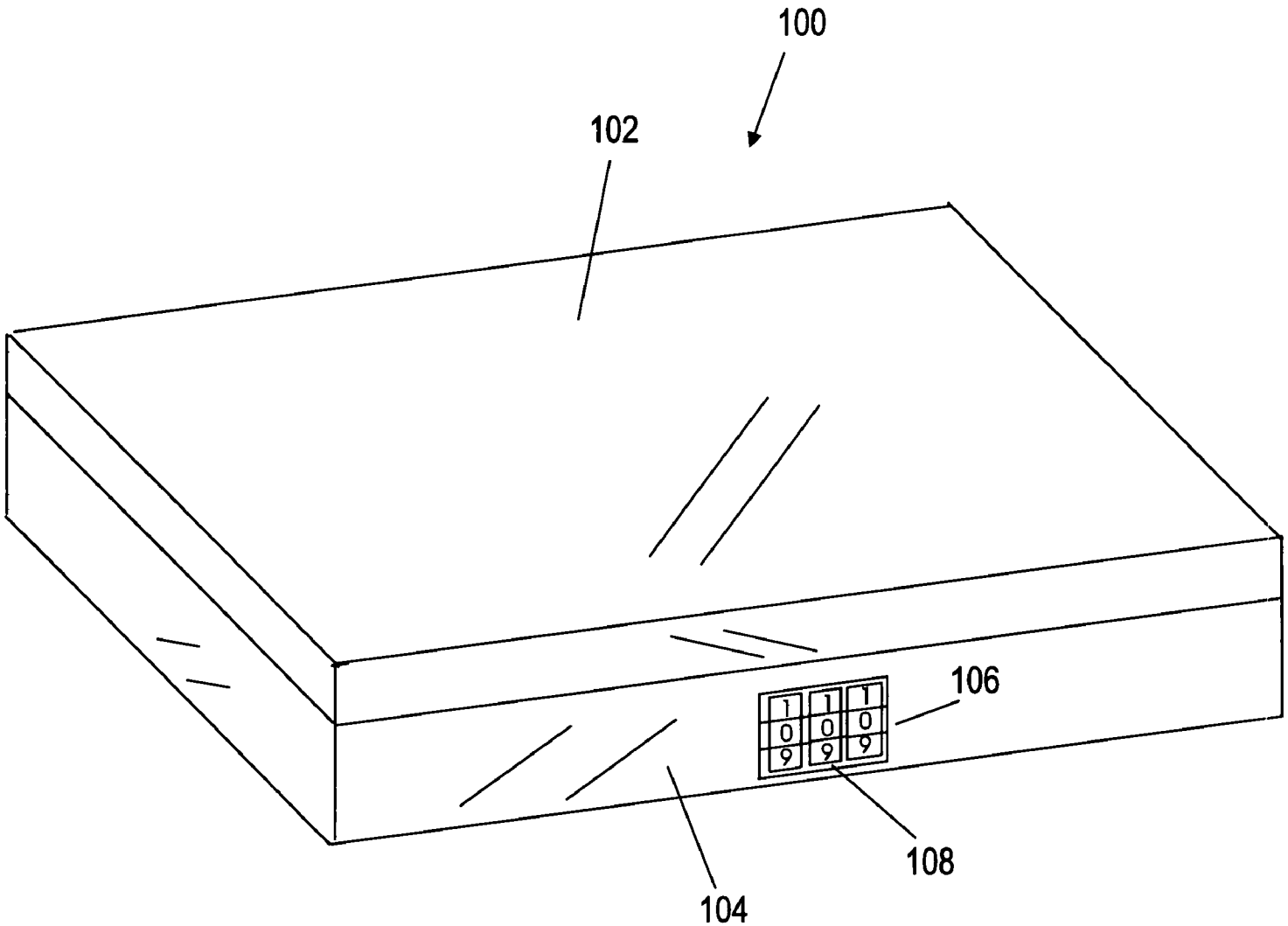
FIG. 2 shows a perspective view of a container or case for use with the apparatus in accordance with an embodiment of the present invention, wherein the container or case is in a closed state.

FIG. 2 shows a perspective view of a container or case 100 for use with the apparatus 1 (shown in FIG. 4) in accordance with an embodiment of the present invention, wherein the container or case 100 is in a closed state. The case 100 includes a top portion or lid 102 and a bottom portion 104. The bottom portion 104 has an opening 106, through which shows a lock 108. The lock 108 may be a combination lock or any other type of lock, fastener, or latch.

Figure 3:
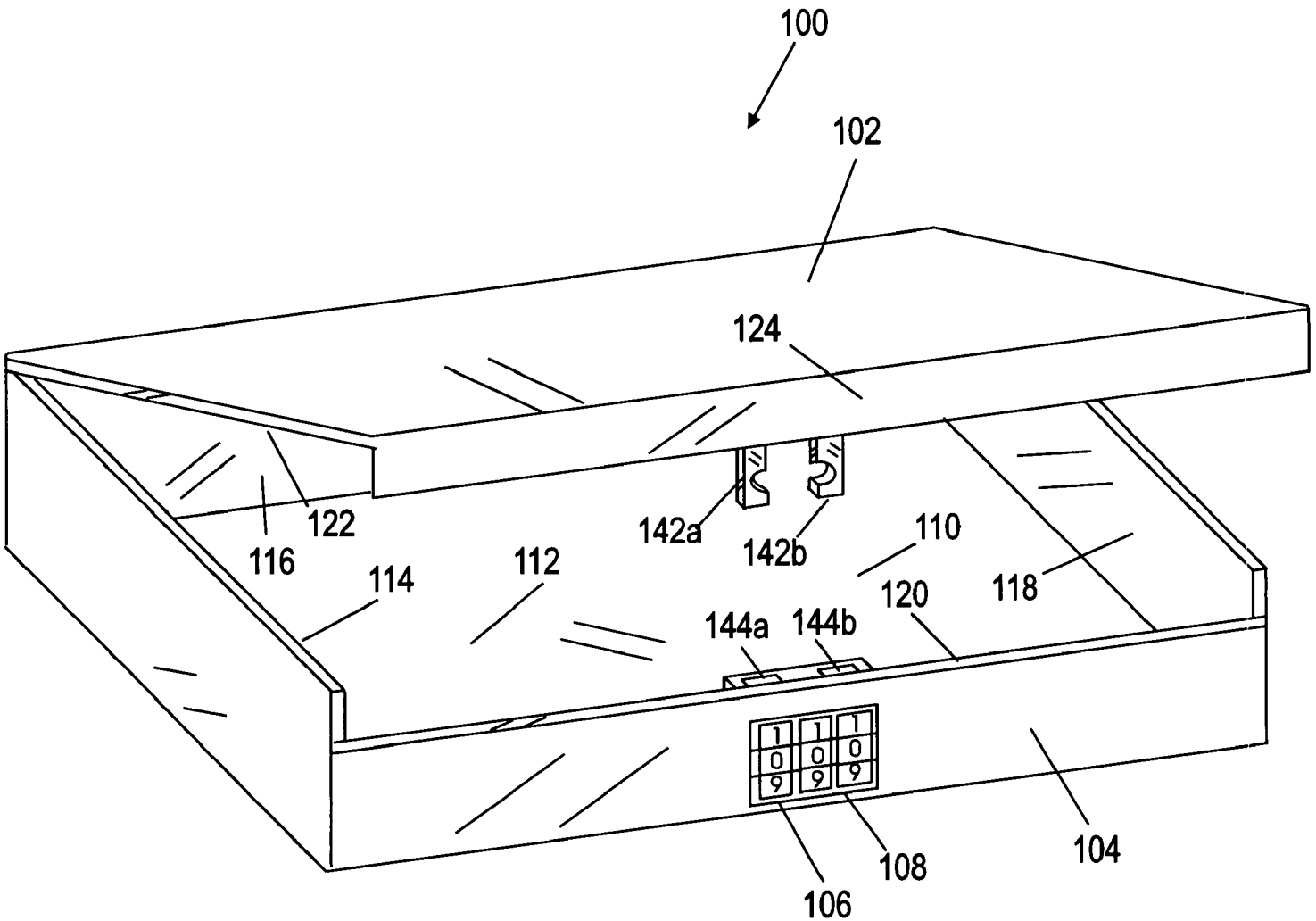
FIG. 3 shows a perspective view of a container or case for use with the apparatus in accordance with an embodiment of the present invention, wherein the container or case is in an open state.

FIG. 3 shows a perspective view of the container or case 100 for use with the apparatus 1 (shown in FIG. 4) in accordance with an embodiment of the present invention, wherein the container or case 100 is in an open state. As shown by FIG. 3, the top portion or lid 102 is hinged to the bottom portion 104 by hinge 130. The bottom portion 104 has sides 114, 116, 118, and 120 which define an open box structure. When the top portion 102 is closed as in FIG. 2, the surface 122 underneath the to portion 102, a fringe or overlap portion 124 of the top portion 102, the a bottom surface 112, and sides 114, 116, 118, and 120 form a closed structure which encloses a chamber or cavity 110, in which a magazine or some other object can be placed.

Attached to portion 102 are latches 142*a* and 142*b*. The latches can be inserted into the openings 144*a* and 144*b* respectively to lock the latches to the lock 108.

Figure 4:
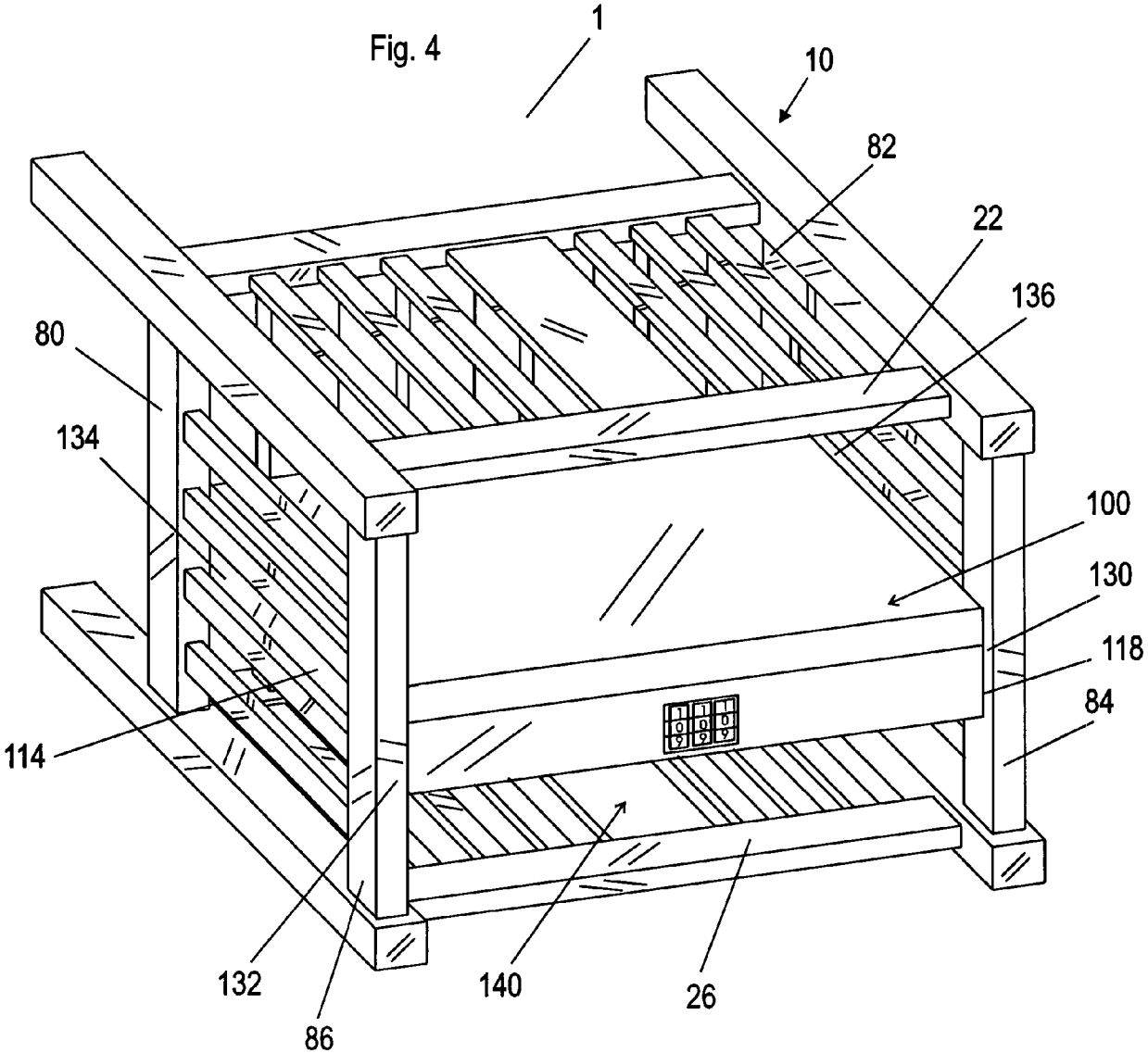
FIG. 4 shows a perspective view of the container of FIG. 2 attached to the base of FIG. 1, with the container in a closed state.

FIG. 4 shows a perspective view of the apparatus 1 in accordance with an embodiment of the present invention comprised of the container 100 of FIG. 2 attached to the base 10 of FIG. 1, with the container 100 shown in a closed state. The side 114 of the container 100 may be glued or otherwise fixed to the columns 80 and 86 of the base 10, at the locations 134 and 132, respectively. The side 118 of the container 100 may be glued or otherwise fixed to the columns 82 and 84 of the base 10, at the locations 130 and 136, respectively. The container 100 can be placed in an open state as in the FIG. 3. The bottom portion 104 of the container 100 is typically fixed in a manner so that the top portion 102 can be rotated upwards about the hinge 130 to put the container 100 in the open state shown in FIG. 3.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

The invention claimed is:

1. An apparatus comprising:

a base; and a container, including a top position and a bottom portion, wherein the top portion of the container is hinged to the bottom portion of the container;

wherein the container is fixed to the base so that the top portion of the container can be rotated upwards to reveal a cavity in the container for storing objects;

wherein the base is comprised of a first column a second column a top portion and a bottom portion the first and second columns substantially perpendicular to the top and bottom portions of the base the first and second columns substantially parallel to each other the top and bottom portions of the base substantially parallel to each other;

wherein the first column has a first end and a second end;

wherein the second column has a first end and a second end;

wherein top portion of the base has a first end and a second end;

wherein the bottom portion of the base has a first end and a second end;

wherein the first end of the top portion of the base is fixed to the first end of the first column and the second end of the top portion of the base is fixed to the first end of the second column;

wherein the first end of the bottom portion of the base is fixed to the second end of the first column and the second end of the bottom portion of the base is fixed to the second end of the second column;

wherein the container is fixed to the base so that container is substantially parallel to and between the top portion of the base and the bottom portion of the base and so that the container is substantially perpendicular to and between the first column and the second column;

and wherein the container is fixed to the base so that top portion of the container lies between the portion of the base and the bottom portion of the base, regardless of the whether the top portion of the container is rotated upwards.

2. The apparatus of claim 1 wherein the container includes a lock which can be locked to prevent the cavity from being exposed.

3. The apparatus of claim 1 wherein the base has an open box structure with a chamber in which the container is placed.

4. The apparatus of claim 2 wherein the base has an open box structure with a chamber in which the container is placed.

5. The apparatus of claim 1 wherein the base is a magazine rack.

6. The apparatus of claim 2 wherein the lock is located substantially centrally between the first column and the second column and substantially centrally between the top portion of the base and the bottom portion of the base.

7. The apparatus of claim 1 wherein the container is fixed to the base so that the top portion of the container lies between the first column and the second column regardless of whether the top portion of the container is rotated upwards.

8. The apparatus of claim 1 wherein the top portion of the base substantially overlaps the top portion of the container and the bottom portion of the container.

9. The apparatus of claim 8 wherein the bottom portion of the base substantially overlaps the top portion of the container and the bottom portion of the container.

10. The apparatus of claim 1 wherein the bottom portion of the base substantially overlaps the top portion of the container and the bottom portion of the container.

11. The apparatus of claim 1 wherein the first column is connected to a third column by a first side portion of the base;

the second column is connected to a fourth column by a second side portion of the base;

the first side portion of the base overlaps a first side portion of the container;

the second side portion of the base overlaps a second side portion of the container;

wherein the first column, the second column, the third column, and the fourth column are substantially parallel to each other;

wherein the first side portion of the base and the second side portion of the base are substantially perpendicular to the first column and substantially parallel to the first side portion of the container and the second side portion of the container; and wherein the first side portion of the container and the second side portion of the container are substantially perpendicular to the bottom portion of the container.

* * * * *